US009067439B2

(12) United States Patent
Herrmann

(10) Patent No.: US 9,067,439 B2
(45) Date of Patent: Jun. 30, 2015

(54) METHOD AND APPARATUS FOR FEEDING MEDIA SHEETS IN AN IMAGE PRODUCTION DEVICE

(75) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 64 days.

(21) Appl. No.: 13/026,400

(22) Filed: Feb. 14, 2011

(65) Prior Publication Data

US 2012/0205857 A1 Aug. 16, 2012

(51) Int. Cl.

| | |
|---|---|
| ***B65H 3/14*** | (2006.01) |
| ***B65H 3/48*** | (2006.01) |
| ***B65H 3/08*** | (2006.01) |
| ***B41J 13/10*** | (2006.01) |
| ***G03G 15/00*** | (2006.01) |

(52) U.S. Cl.

CPC ..... *B41J 13/103* (2013.01); *B65H 3/0825* (2013.01); *B65H 3/48* (2013.10); *B65H 3/0816* (2013.01); *B65H 3/14* (2013.01); *B65H 2701/1313* (2013.01); *B65H 2801/06* (2013.01); *G03G 15/6511* (2013.01)

(58) Field of Classification Search

CPC ..... B65H 3/14; B65H 3/0816; B65H 3/0825; B65H 3/48; B65H 2701/1313

USPC ..... 271/97, 98, 105; 294/64.3

See application file for complete search history.

(56) References Cited

U.S. PATENT DOCUMENTS

| | | | | |
|---|---|---|---|---|
| 2,819,075 | A * | 1/1958 | Noon | 271/97 |
| 3,168,307 | A * | 2/1965 | Munchbach et al. | 271/97 |
| 3,219,340 | A * | 11/1965 | Hori et al. | 271/11 |
| 3,411,770 | A * | 11/1968 | Albright | 271/97 |
| 3,539,216 | A * | 11/1970 | Forcier | 294/64.3 |
| 3,547,431 | A * | 12/1970 | Wagner | 271/11 |
| 4,364,550 | A * | 12/1982 | Hynes | 271/11 |
| 5,470,420 | A | 11/1995 | Yokajty | |
| 5,472,543 | A | 12/1995 | Yokajity | |
| 6,279,896 | B1 * | 8/2001 | Linder et al. | 271/98 |
| 6,554,269 | B1 | 4/2003 | Dobbertin et al. | |
| 7,007,944 | B1 | 3/2006 | Dobbertin et al. | |
| 2004/0041328 | A1 * | 3/2004 | DiNatale et al. | 271/97 |

FOREIGN PATENT DOCUMENTS

| | | | |
|---|---|---|---|
| JP | 55123830 | A * | 9/1980 |
| JP | 61229750 | A * | 10/1986 |
| JP | 01209243 | A * | 8/1989 |
| JP | 04016434 | A * | 1/1992 |

* cited by examiner

*Primary Examiner* — Luis A Gonzalez

(74) *Attorney, Agent, or Firm* — Ronald E. Prass, Jr.; Prass LLP

(57) ABSTRACT

A method and apparatus for feeding media sheets in an image production device is disclosed. The method may include applying air downward to a top of a trailing edge of a media sheet located at a top of a media stack that is to be fed to an image production section of the image production device, the applied air causing the top media sheet to separate from the media stack, and feeding the separated top media sheet to the image production section.

6 Claims, 5 Drawing Sheets

METHOD AND APPARATUS FOR FEEDING MEDIA SHEETS IN AN IMAGE PRODUCTION DEVICE

BACKGROUND

Disclosed herein is a method for method and apparatus for feeding media sheets in an image production device, as well as corresponding apparatus and computer-readable medium.

In image production devices where sheets are fed from a media stack, it is important to attain consistent separation of the top media sheet from the rest of the media stack, especially media sheets of larger length. This is especially important in vacuum corrugation feeding due to the lower acquisition forces available.

If the top media sheet is not fully separated due to edge welds (sheets sticking together at the edges from the shearing operation at the mill), or other contact issues caused by ambient conditions and interactions with the paper coatings, the feed head may not acquire the sheet properly and this may lead to several failure conditions. These issues generally result in multi-feeds, such as when 2 or more media sheets are acquired and fed as a single media sheet, or mis-feeds, such as when a media sheet is not acquired within the necessary time to match the system pitch timing.

In an attempt to separate the top media sheets at the trailing edge of the media stack conventional image production devices use "fluffers" to force air into the media stack. The theory of fluffing up the trail edge of the stack is based on the idea that when the top media sheet is being acquired by the feed head the resistance at the trail edge of the media sheet can be reduced by forcing air into the trail edge of the media stack.

However, the air being forced into the media stack cannot be directed accurately enough to always separate the top media sheet. The fluffer forces air to a subset of media sheets at the top of the media stack and does not always focus on the separation of the top media sheet.

SUMMARY

A method and apparatus for feeding media sheets in an image production device is disclosed. The method may include applying air downward to a top of a trailing edge of a media sheet located at a top of a media stack that is to be fed to an image production section of the image production device, the applied air causing the top media sheet to separate from the media stack, and feeding the separated top media sheet to the image production section.

DETAILED DESCRIPTION

Figure 1:
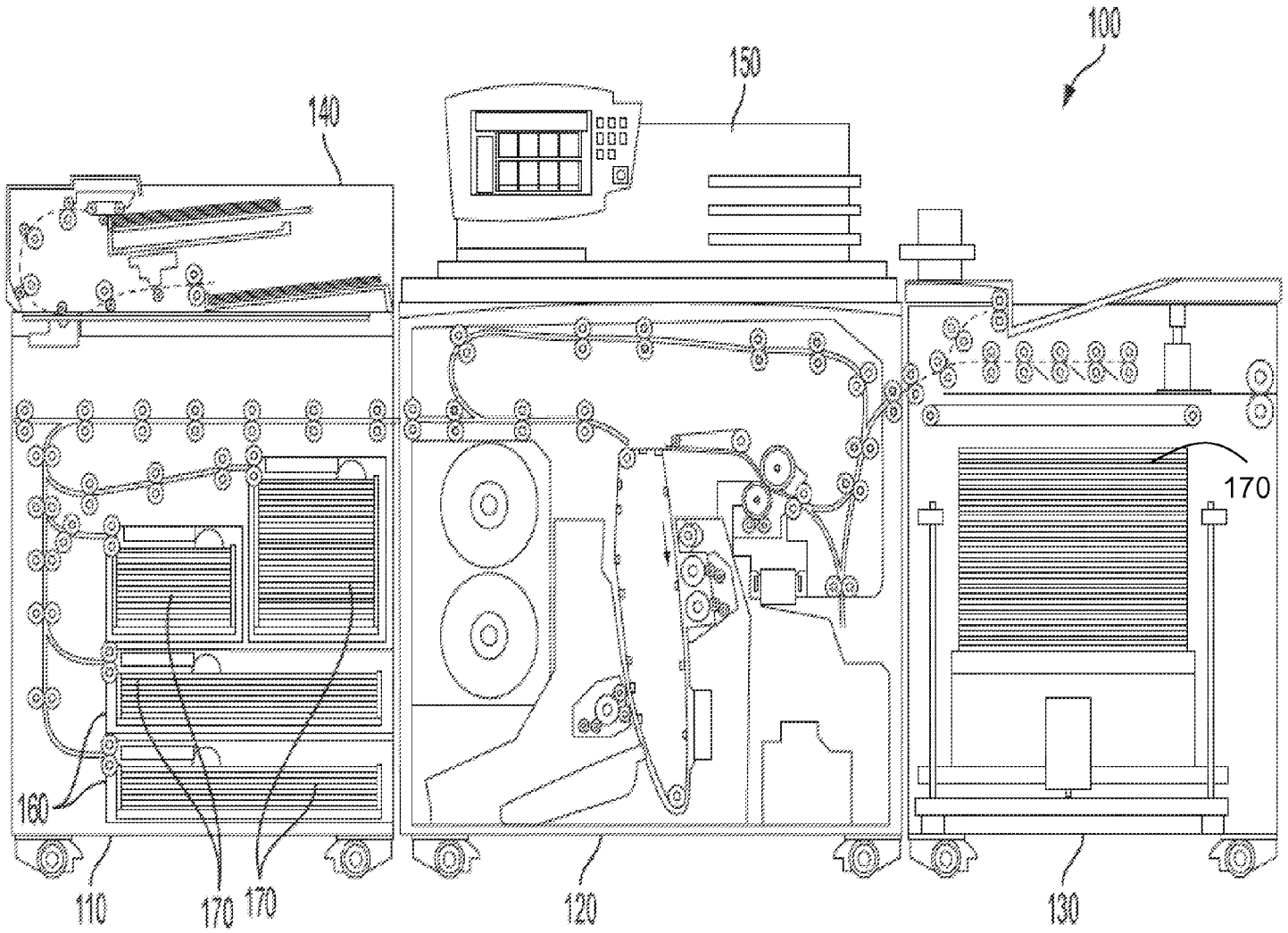
FIG. 1 is an exemplary diagram of an image production device in accordance with one possible embodiment of the disclosure.

Aspects of the embodiments disclosed herein relate to a method for feeding media sheets in an image production device, as well as corresponding apparatus.

The disclosed embodiments may include a method for feeding media sheets in an image production device. The method may include applying air downward to a top of a trailing edge of a media sheet located at a top of a media stack that is to be fed to an image production section of the image production device, the applied air causing the top media sheet to separate from the media stack, and feeding the separated top media sheet to the image production section.

The disclosed embodiments may further include an image production device that may include a sheet separation unit that applies air downward to a top of a trailing edge of a media sheet located at a top of a media stack that is to be fed to an image production section of the image production device, the applied air causing the top media sheet to separate from the media stack, and a feeder section that feeds the separated top media sheet to the image production section.

The disclosed embodiments may further include a feeder section of an image production device that may include a sheet separation unit that applies air downward to a top of a trailing edge of a media sheet located at a top of a media stack that is to be fed to an image production section of the image production device, the applied air causing the top media sheet to separate from the media stack, and a feed head that feeds the separated top media sheet to the image production section.

The disclosed embodiments may concern feeding media sheets in an image production device. The disclosed embodiments concern a method and apparatus that may take advantage of the Bernoulli effect by forcing high velocity air across the top of a media sheet to lift the top media sheet by using the pressure differential caused by the air moving over the media sheet surface. The disclosed embodiments may ensure that lift is applied to the top media sheet. By forcing the air down through a hole in a plate, the air then creates a high speed boundary layer between the plate and the top media sheet in the media stack. Although counterintuitive, the air being applied down toward the media sheet causes the media sheet to be "acquired" quickly and consistently.

Additionally as the media sheet is "acquired", the boundary layer of air remains and provides a low friction interface between the media sheet and the plate. This helps the feed head acquire the media sheet since it lowers the drive forces required to feed the sheet. This aspect of the embodiments provides media sheet lift while reducing the contact friction of the plate.

As sheet sizes get larger, space around the media stack become more constrained. This method and apparatus allows for the media sheet separation to be addressed from above the media stack rather than the side of the media stack. In this manner, the disclosed embodiments provide:

- Plate air system that uses pressure differential caused by high velocity air to lift top media sheet of a media stack at the trailing edge for top media sheet feed systems to separate top media sheet. (i.e., for a vacuum corrugation feeder).
- Use of boundary layer of air across bottom surface of plate to provide a low friction contact to reduce the frictional forces of the media sheet acquisition system during the feed operation once trail edge of the media sheet is separated.

Benefits of the disclosed embodiments may include:

- Acquires top media sheet of a media stack to reduce loading of a vacuum corrugation feed head.

Improves acquisition especially for longer media sheets where the load on the feed head is higher.

Reduces the forced fluffing issues of multi-sheet acquisition.

Boundary layer of high velocity air provides dual function of top media sheet acquisition and low friction surface that reduces media sheet to plate frictional loads.

Allows for air application from above the media stack rather than from the side as in forced air fluffers for reduced footprint and increased sheet size.

FIG. 1 is an exemplary diagram of an image production device 100 in accordance with one possible embodiment of the disclosure. The image production device 100 may be any device or combination of devices that may be capable of making image production documents (e.g., printed documents, copies, etc.) including a copier, a printer, a facsimile device, and a multi-function device (MFD), for example.

The image production device 100 may include an image production section 120, which includes hardware by which image signals are used to create a desired image, as well as a stand-alone feeder section 110, which stores and dispenses sheets on which images are to be printed, and an output section 130, which may include hardware for stacking, folding, stapling, binding, etc., prints which are output from the marking engine. If the image production device 100 is also operable as a copier, the image production device 100 may further include a document feeder 140, which operates to convert signals from light reflected from original hard-copy image into digital signals, which are in turn processed to create copies with the image production section 120. The image production device 100 may also include a local user interface 150 for controlling its operations, although another source of image data and instructions may include any number of computers to which the printer is connected via a network.

With reference to feeder section 110, the section may include any number of feeder trays 160, each of which stores a media stack 170 or print sheets ("media") of a predetermined type (size, weight, color, coating, transparency, etc.) and may include a feeder to dispense one of the sheets therein as instructed. Certain types of media may require special handling in order to be dispensed properly. For example, heavier or larger media may desirably be drawn from a media stack 170 by use of an air knife, fluffer, vacuum grip or other application (not shown in the Figure) of air pressure toward the top sheet or sheets in a media stack 170. Certain types of coated media may be advantageously drawn from a media stack 170 by the use of an application of heat, such as by a stream of hot air (not shown in the Figure). Sheets of media drawn from a media stack 170 on a selected feeder tray 160 may then be moved to the image production section 120 to receive one or more images thereon. Then, the printed sheet is then moved to output section 130, where it may be collated, stapled, folded, punched, etc., with other media sheets in manners familiar in the art.

Note that the image production device 100 may be or may include a stand-alone feeder section 110 (or module) and/or a stand-alone output (finishing) section 130 (or module within the spirit and scope of the disclosed embodiments.

Figure 2:
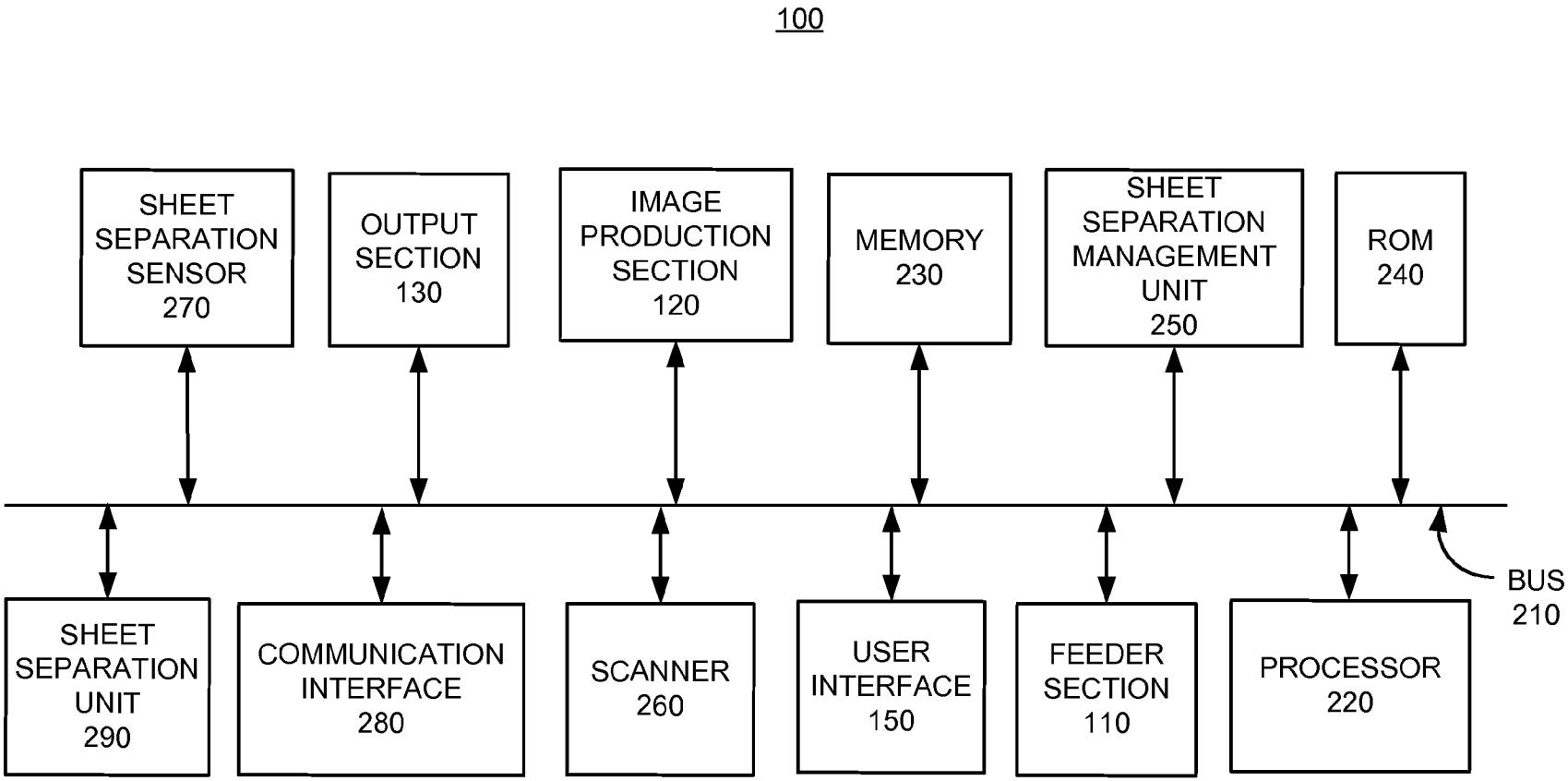
FIG. 2 is an exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM) 240, a sheet separation management unit 250, a feeder section 110, an output section 130, a user interface 150, a scanner 260, a sheet separation sensor 270, a communication interface 280, an image production section 120, and a sheet separation unit 290. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 150 may include one or more conventional mechanisms that permit a user to input information to and interact with the image production unit 100, such as a keyboard, a display, a mouse, a pen, a voice recognition device, touchpad, buttons, etc., for example. Output section 130 may include one or more conventional mechanisms that output image production documents to the user, including output trays, output paths, finishing section, etc., for example. The image production section 120 may include an image printing and/or copying section, a scanner, a fuser, etc., for example. The scanner 260 may be any device that may scan documents and may create electronic images from the scanned document. The scanner 260 may also scan, recognize, and decode marking-readable codes or markings, for example.

The sheet separation sensor 270 may be a contact image sensor (CIS), or a two-dimensional (2D) sensor array, a timing sensor, a contact sensor, etc., for example. In this manner, the sheet separation sensor 270 may serve a function of determining if the top media sheet from the media stack 170 has been acquired by one or more feed heads in the feeder section 110 and fed to the image production section 120.

In one possible embodiment, the sheet separation sensor 270 may sense whether the top media sheet has been acquired by the image production section 120. If the sheet separation sensor 270 senses that the top media sheet has not been acquired by the image production section 120, the sheet separation management unit 250 may adjust the amount of air applied to the top media sheet.

In yet another possible embodiment, the sheet separation sensor 270 may sense whether the top media sheet has been acquired by the image production section 120 within a predetermined time period. If the sheet separation sensor 270 senses that the top media sheet has not been acquired by the image production section 120 within a predetermined time period, the sheet separation management unit 250 may adjust the amount of air applied to the top media sheet. The predetermined time period may be 0.5-3 seconds, for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The operation of the sheet separation unit 290 will be discussed in relation to the diagram in FIGS. 3 and 4, and the flowchart in FIG. 5.

Figure 3:
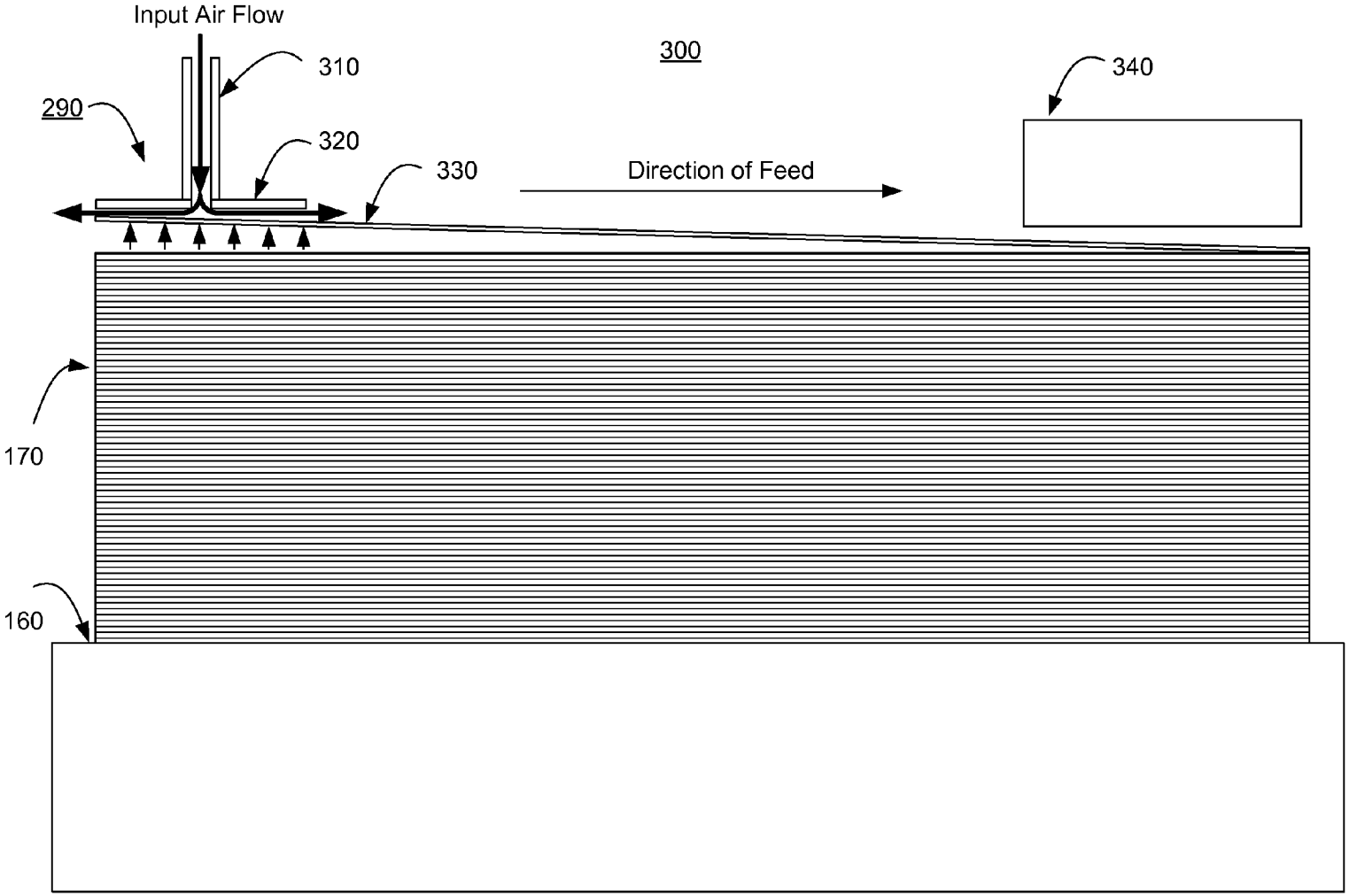
FIG. 3 is an exemplary diagram of a side view of a media sheet separation environment in accordance with one possible embodiment of the disclosure.

FIG. 3 is an exemplary diagram of a side view of a media sheet separation environment 300 in accordance with one possible embodiment of the disclosure. The media sheet separation environment 300 may include the sheet separation unit 290, the feeder tray 160, the media stack 170, the top media sheet 330, and the feed head 340. The sheet separation unit 290 may include an air flow path 310 leading to one or more holes, and a plate 320. The plate 320 may have a bottom surface facing parallel to the top media sheet 330, as shown.

In operation, air may be applied from any blower know to one of skill in the art (not shown) and may travel down the air flow path 310 to one or more holes in plate 320. As shown, the Bernoulli effect causes the trailing edge of the media sheet 330 at the top of the media stack 170 to rise to enable the media sheet 330 to be properly acquired and fed by the feed head 340 of the feeder section 110 to then be acquired by the image production section 120.

Figure 4:
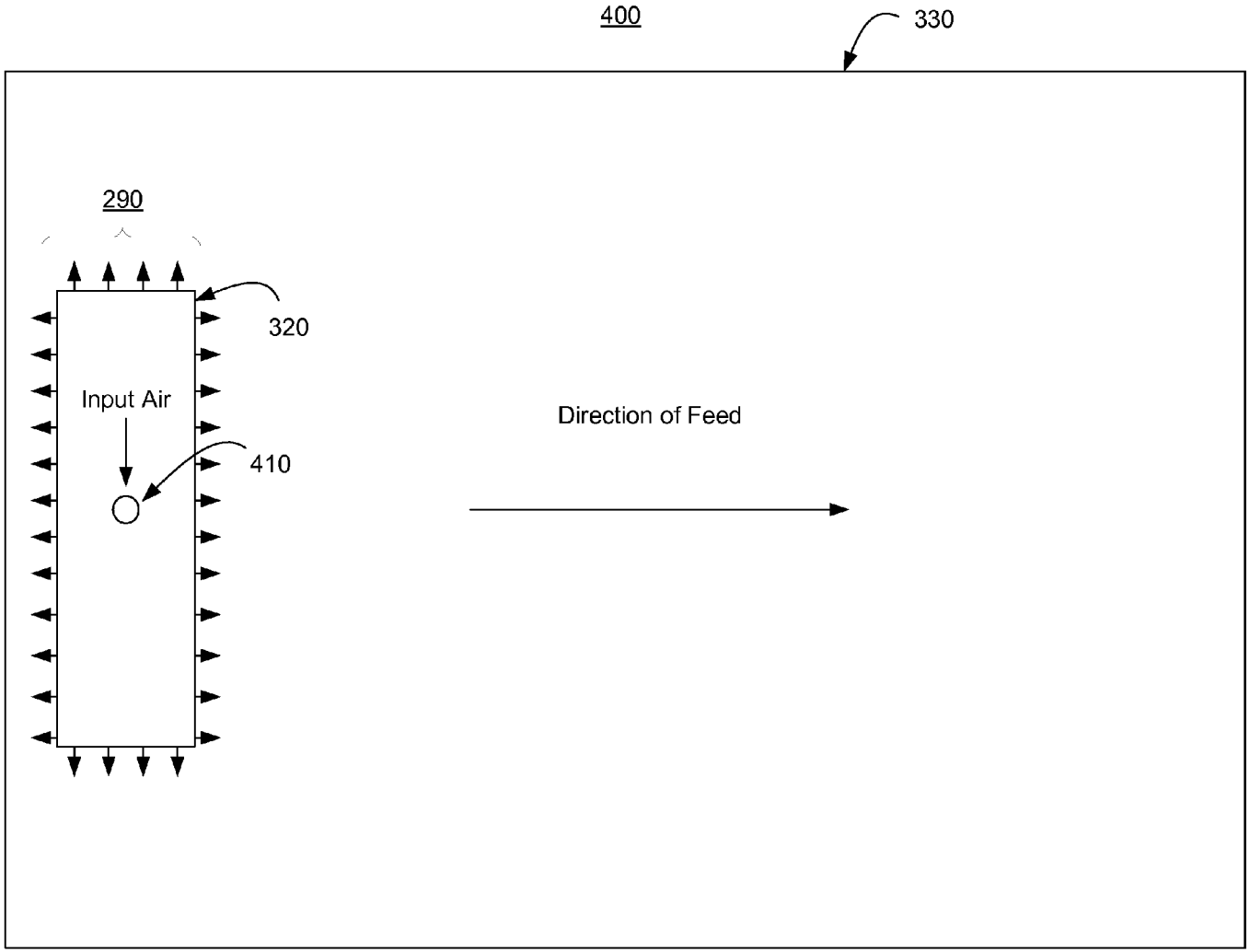
FIG. 4 is an exemplary diagram of a top view of a media sheet separation environment in accordance with one possible embodiment of the disclosure.

FIG. 4 is an exemplary diagram of a top view of a media sheet separation environment 400 in accordance with one possible embodiment of the disclosure. The media sheet separation environment 400 may include the sheet separation unit 290, and the top media sheet 330. The sheet separation unit 290 may include the plate 320 and one or more holes 410 in the media plate through which air is applied to the top media sheet 330. The one or more holes 410 may be 4 mm-10 mm in diameter, for example. The air may be applied approximately 1"-3" horizontally from the trailing edge of the top media sheet 330, for example.

Figure 5:
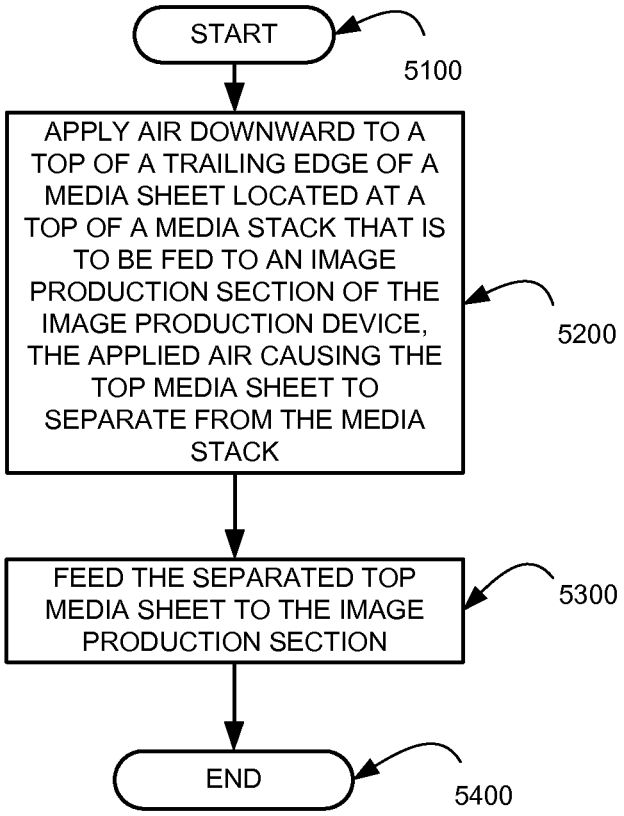
FIG. 5 is a flowchart of an exemplary media sheet feeding process in accordance with one possible embodiment of the disclosure.

FIG. 5 is a flowchart of an exemplary media sheet feeding process in accordance with one possible embodiment of the disclosure. The method may begin at step 5100, and may continue to step 5200, where the sheet separation unit may apply air downward to the top of a trailing edge of a media sheet 330 located at a top of a media stack 170 that is to be fed to the image production section 120 of the image production device 100. The applied air may cause the top media sheet 330 to separate from the media stack 170. Note that the trailing edge of the media sheet 330 may be the edge furthest away from a direction that the media sheet 330 is to be fed. At step 5300, the feeder section 110 feeds the separated top media sheet 330 to the image production section 120. The process may then go to step 5400 and end.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An image production device, comprising:

a sheet separation unit that applies air vertically downward through a single air supply hole in a bottom surface plate, without using conventional fluffing techniques, toward a top surface of a trailing edge of a top media sheet positioned at a top of a media stack and positioned to be fed to an image production section of the image production device, the sheet separation unit (1) being configured to cause the applied air exiting the single air supply hole to impinge on the top media sheet and to be diverted in substantially all directions across a top surface of the top media sheet at the trailing edge creating a Bernoulli effect that causes the top media sheet to separate from the media stack, the bottom surface plate facing parallel to the top media sheet, the single air supply hole in the bottom surface plate being 5.5mm-10mm in diameter;

a feeder section to feed an acquired top media sheet to the image production section;

a sheet separation sensor that senses whether the top media sheet has been acquired by the image production section;

a sheet separation management unit having a processor coupled to a storage device, wherein the storage device contains instructions operative on the processor for:

waiting a predetermined time period to sense with the sheet separation sensor if the top media sheet has been acquired by the image production section, wherein the predetermined time period is 0.5-3.0 seconds; and if after waiting the predetermined period and determining that the top media sheet has not been acquired by the image production section, then adjusting the air applied to the top media sheet.

2. The image production device of claim 1, wherein the image production device is one of a copier, a printer, a facsimile device, and a multi-function device.

3. A feeder section of an image production device, comprising:

a sheet separation unit that applies air vertically downward through a single air supply hole in a bottom surface plate, without using conventional fluffing techniques, toward a top surface of a trailing edge of a top media sheet positioned at a top of a media stack and positioned to be fed to an image production section of the image production device, the sheet separation unit (1) being configured to cause the applied air exiting the single air supply hole to impinge on the top media sheet and to be diverted in substantially all directions across a top surface of the top media sheet at the trailing edge creating a Bernoulli effect that causes the top media sheet to separate from the media stack, the bottom surface plate facing parallel to the top media sheet, the single air supply hole in the bottom surface plate being 5.5mm-10mm in diameter;

a sheet separation sensor that senses whether the top media sheet is acquired by the image production section within a predetermined time period, the predetermined time period being 0.5-3.0 seconds;

a sheet separation management unit having a processor coupled to a storage device, wherein the storage device contains instructions operative on the processor to determine if the top media sheet is not acquired by the image production section within the predetermined time period of 0.5-3.0 seconds so as to adjust the air applied to the top media sheet; and a feed head that feeds the acquired top media sheet to the image production section.

4. The feeder section of claim 3, wherein the image production device is one of a copier, a printer, a facsimile device, and a multi-function device.

5. A method for feeding a media sheet with a trailing edge and a leading edge to an image production section of an image production device, the method comprising:

applying high velocity air across a top of the media sheet to cause a Bernoulli effect at the trailing edge of the media sheet, wherein the high velocity air is produced by a sheet separation unit having a plate with one or more holes of 5.5mm-10mm in diameter and wherein the high velocity air is applied approximately 1"-3" horizontally from the trailing edge of the media sheet;

lifting at the trailing edge of the media sheet off a media stack by using the Bernoulli effect as caused by the high velocity air moving over the media sheet surface;

acquiring using a feed head the media sheet from the media stack so it could be processed by the image production section;

feeding the acquired media sheet to the image production section for processing;

waiting a predetermined time period to sense whether the media sheet has been acquired by the image production section, wherein the predetermined time period is 0.5-3.0 seconds; and if after waiting the predetermined period and determining that the media sheet has not been acquired by the image production section, then adjusting the high velocity air applied to the media sheet.

6. The method of claim 5, wherein the image production device is one of a copier, a printer, a facsimile device, and a multi-function device.

* * * * *